US008025276B2

(12) United States Patent
Fisher, Jr. et al.

(10) Patent No.: US 8,025,276 B2
(45) Date of Patent: Sep. 27, 2011

(54) MANDREL TO FACILITATE THIN SHEET FABRICATION

(75) Inventors: Dale Madard Fisher, Jr., Painted Post, NY (US); Elizabeth Mary Sturdevant, Horseheads, NY (US); Wenchao Wang, Ithaca, NY (US)

(73) Assignee: Corning Incorporated, Corning, NY (US)

( * ) Notice: Subject to any disclaimer, the term of this patent is extended or adjusted under 35 U.S.C. 154(b) by 420 days.

(21) Appl. No.: 12/412,675

(22) Filed: Mar. 27, 2009

(65) Prior Publication Data

US 2010/0038836 A1 Feb. 18, 2010

Related U.S. Application Data

(60) Provisional application No. 61/089,677, filed on Aug. 18, 2008.

(51) Int. Cl.
*B23Q 3/14* (2006.01)
*B23P 25/00* (2006.01)

(52) U.S. Cl. ..... 269/48.1; 29/458

(58) Field of Classification Search ..... 269/48.1, 269/48.2, 49, 50, 51; 29/458
See application file for complete search history.

(56) References Cited

U.S. PATENT DOCUMENTS

| | | | | |
|---|---|---|---|---|
| 81,420 | A | 8/1868 | Shur | |
| 243,469 | A | 6/1881 | Stark | |
| 1,937,644 | A | 12/1933 | Eaton | 10/107 |
| 2,139,771 | A | 12/1938 | Riemenschnelder | 219/10 |
| 2,272,698 | A | 2/1942 | Garrett et al. | 113/103 |
| 2,323,039 | A | 6/1943 | Hill | 113/103 |
| 2,399,815 | A * | 5/1946 | Martin | 228/199 |
| 2,515,786 | A | 7/1950 | Mitchell | 153/33 |
| 2,685,829 | A | 8/1954 | Taber | 93/77 |
| 3,371,409 | A * | 3/1968 | Bonnet et al. | 29/458 |
| 4,387,845 | A | 6/1983 | Mefferd | 228/222 |
| 4,828,161 | A | 5/1989 | Million | 228/46 |
| 5,327,765 | A * | 7/1994 | Weykamp et al. | 72/296 |
| 5,466,114 | A * | 11/1995 | Swain | 414/746.5 |
| 6,412,765 | B1 * | 7/2002 | Blakeley | 269/48.1 |
| 6,742,785 | B1 * | 6/2004 | Weller | 279/2.17 |
| 2008/0290138 | A1 | 11/2008 | Lineman et al. | 228/122.1 |

* cited by examiner

*Primary Examiner* — David B Thomas
(74) *Attorney, Agent, or Firm* — Jeffrey A. Schmidt

(57) ABSTRACT

A mandrel 1 includes a top support 10, a first edge support 20, a bottom support 30, and a second edge support 40. The top support and first edge support make-up a first support section. The bottom support and second edge support make-up a second support section. The first support section and the second support section are disposed relative to one another so as to form an outer circumference. A jack 50 is coupled to the first and second support sections and is configured to move the first and second support sections relative to one another so as to adjust the outer circumference of the mandrel. A locking element 60 removably is coupled to the first and second support sections to selectively prevent relative movement between the first and second support sections.

20 Claims, 5 Drawing Sheets

MANDREL TO FACILITATE THIN SHEET FABRICATION

RELATED APPLICATION

This application claims the benefit of priority under 35 U.S.C. §119(e) of U.S. Provisional Application Ser. No. 61/089,677 filed on Aug. 18, 2008, entitled, "Mandrel to Facilitate Thin Sheet Fabrication," the content of which is relied upon and incorporated herein by reference in its entirety.

TECHNICAL FIELD

The present invention relates to a mandrel and methods for fabricating tubes using the mandrel. More particularly, the present invention relates to a mandrel for fabricating tubes made from thin sheets of material.

BACKGROUND

Platinum delivery systems have been used in the process of making glass and, in particular, in the process of making glass for LCD devices. Because the glass for LCD devices needs to be of very high quality, the interior of the platinum system coming into contact with the glass should not be contaminated or scratched. Any contamination or scratching of the interior of the platinum system may create unwanted defects in the glass produced using that platinum system, thereby leading to losses on the part of the glass manufacturer. A typical platinum system includes various tubes that extend between and convey glass among various process and/or apparatuses. For example, there may be a platinum tube between: portions of a pre-melt apparatus; a pre-melt apparatus and a fining chamber; a fining chamber and a stir chamber; a stir chamber and a holding tank. The platinum tube may be scratched, deformed, or otherwise damaged, during removal of a mandrel used to form the tube. Alternatively, or in addition thereto, the interior of the platinum tube may be contaminated, scratched, or otherwise damaged, by the material from which the mandrel is made.

Further, because the cost of platinum is high and ever increasing, there is an effort to reduce the amount of platinum necessary for the delivery system in the glass-making process. One measure for reducing the amount of platinum necessary is to reduce the thickness of the platinum tubes in the delivery system. However, as platinum sheet thickness decreases, the inherent rigidity of the sheet material also decreases, thereby making manufacture difficult. In particular, for example, the reduced thickness of the platinum tubes makes it difficult for the tube to support itself during processes including high mechanical forces and high heat.

In the past, mandrels for manufacturing platinum tubes have been made of solid bodies of nylon. Because this type of mandrel is a solid body, it is often difficult to remove the mandrel from the tube without deformation of the metal. Further, because this type of mandrel is made of nylon, it cannot remain in the tube during processes that include high heat otherwise the nylon may melt and contaminate the interior of the tube.

SUMMARY

According to one aspect, there is provided a mandrel that reduces the risk of damage to the tube formed thereon. The mandrel has an adjustable outer circumference, and is easily disassembled, to facilitate removal of the mandrel from a tube without scratching or otherwise damaging the interior of the tube. The mandrel includes a first support section and a second support section that form an outer circumference of the mandrel, wherein the outer circumference can be expanded or contracted by moving the first and second support sections relative to one another. Further, each of the first and second support sections may be disassembled into smaller parts. Because the circumference of the mandrel is adjustable, the mandrel can be sized to the desired circumference of the tube to be manufactured. After manufacture and processing of the tube, the mandrel easily can be contracted and disassembled to facilitate removal from the tube without scratching or otherwise damaging the interior of the tube.

According to another aspect, there is provided a mandrel that is capable of withstanding high mechanical forces and/or high heat and, therefore, may remain in a platinum tube throughout many steps of its formation and processing. Because the mandrel is capable of remaining within the platinum tube through all stages of its manufacture, the mandrel facilitates the manufacture of thin platinum tubes. The mandrel includes a locking element coupled to the first and second support sections to selectively prevent relative movement between the first and second support sections. Accordingly, the mandrel is a rigid structure capable of withstanding high mechanical forces. Additionally, the mandrel may also include wedges to provide further structural rigidity to the support sections. Further, the mandrel may be made of or coated with materials having a high thermal conductivity and high thermal shock resistance, to withstand the localized heat used during processing of the tube, as in plasma spray coating for example. Also, these materials have a smooth surface that will not contaminate or scratch the interior of the platinum tube.

According to another aspect, there is provided a mandrel including structure that provides heating or cooling of the tube being processed on the mandrel as well as of the mandrel itself. The mandrel may include a heat-transfer-medium inlet for introducing a heat-transfer medium to the interior of the mandrel. The heat-transfer medium may be circulated through the mandrel and/or caused to exit the surface of the mandrel to provide a heating or cooling effect Because the mandrel may be cooled, the mandrel may be capable of withstanding even higher temperatures than the mandrel otherwise could based only on the material from which the mandrel is made. Accordingly, the mandrel can remain in the tube during even higher temperature processes performed on the tube.

According to another aspect, to facilitate welding the tube with the mandrel in place, the first support section further includes a recess. Additionally, there is provided a block sized so that it may be removably disposed within the recess. The block may be removed from the recess to facilitate welding, and be inserted into the recess to facilitate other processes Although the mandrel is described in terms of its use for platinum tube fabrication, it can be used to fabricate tubes of other materials as well. Further, the various aspects of the mandrel as set forth herein may be used separately or in various combinations with one another Additional features and advantages of the invention will be set forth in the detailed description which follows, and in part will be readily apparent to those skilled in the art from the description or recognized by practicing the invention as described in the written description and claims hereof, as well as the appended drawings.

It is to be understood that both the foregoing general description and the following detailed description are merely exemplary of the invention, and are intended to provide an overview or framework to understanding the nature and character of the invention as it is claimed.

The accompanying drawings are included to provide a further understanding of principles of the invention, and are incorporated in and constitute a part of this specification. The drawings illustrate one or more embodiment(s), and together with the description serve to explain the principles and operation of the invention.

DETAILED DESCRIPTION

Figure 1:
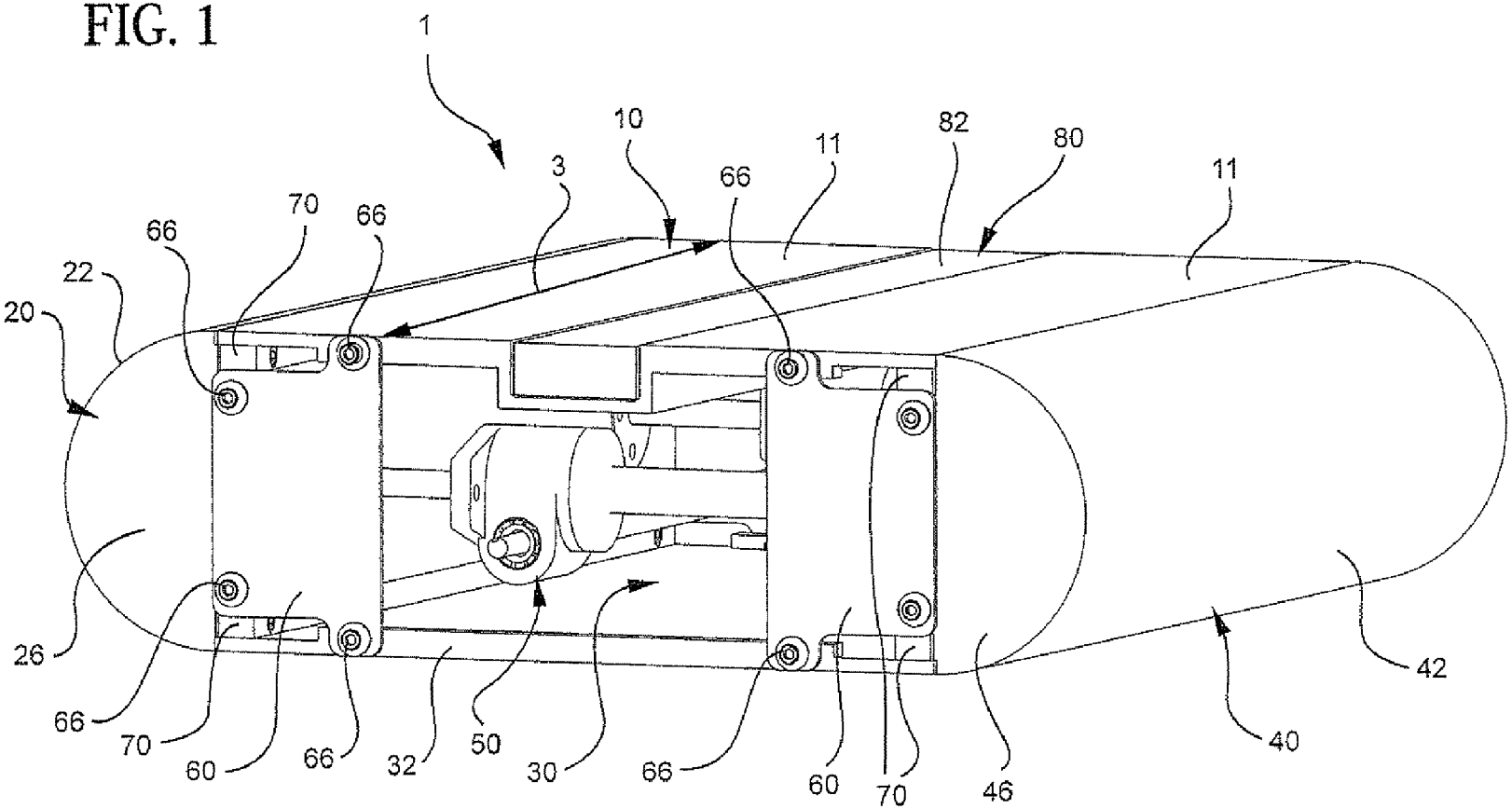
FIG. 1 is a perspective view of a mandrel.

In the following detailed description, for purposes of explanation and not limitation, example embodiments disclosing specific details are set forth to provide a thorough understanding of the principles of the present invention. However, it will be apparent to one having ordinary skill in the art, having had the benefit of the present disclosure, that the present invention may be practiced in other embodiments that depart from the specific details disclosed herein. Moreover, descriptions of well-known devices, methods and materials may be omitted so as not to obscure the description of the principles of the present invention. Finally, wherever applicable, like reference numerals refer to like elements.

References to right, left, top, bottom, front, and rear, are made with respect to the mandrel as shown in the figures, are for ease of description only, and are not meant to be limiting. The structure and function of the mandrel are not specifically limited by its orientation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

According to one aspect, there is provided a mandrel that has an adjustable circumference to facilitate removal of the mandrel from a tube formed thereon without scratching or otherwise damaging the interior of the tube. According to another aspect, the mandrel has a locking element to make the mandrel rigid so that the mandrel may withstand high mechanical forces that may be present during forming or processing the tube. According to yet another aspect, the mandrel can be easily disassembled to assist in reducing damage to the tube as the mandrel is removed from the tube. Further, according to still yet another aspect, the mandrel is made of a material that provides high thermal conductivity, high resistance to thermal shock, and high heat resistance, so that the mandrel may be used during processes that require high heat, for example plasma coating. Additionally, the material may provide a smooth surface that further reduces the risk of damage to the interior of the tube during removal of the mandrel. Accordingly, there can be provided a mandrel that is easily removed from a tube with reduced risk of damage to the interior of the tube, and that may be used during many phases of tube formation and processing.

A mandrel 1 according to one embodiment is shown in FIG. 1. Mandrel 1 includes a top support 10, a first edge support 20, a bottom support 30, and a second edge support 40, that are coupled together so as to present an outer circumference for supporting a tubular structure as the tubular structure is formed and processed. The mandrel 1 has a length 3. The top support 10 and first edge support 20 make up a first support section, whereas the bottom support 30 and the second edge support 40 make up a second support section.

The first support section and second support section are coupled together by a jack screw 50 and plates 60 so as to provide adjustability and selective rigidity to the mandrel 1. The jack screw 50 allows the circumference of the mandrel 1 to be adjusted so that after fabrication and processing of a tube, the circumference of the mandrel 1 can be made smaller, by moving the first and second support sections relative to one another for example, to facilitate removal of the mandrel 1 without scratching or otherwise damaging the interior of the tube just fabricated. Additionally, the plates 60 provide rigidity to the mandrel 1, and yet allow the mandrel 1 to be disassembled for removal from a tube without scratching or otherwise damaging the tube. More specifically, the plates 60 form a locking element removably coupled to the first and second support sections to selectively prevent relative movement between the first and second support sections. When the plates 60 are fastened in place, the mandrel 1 can be made rigid for fabrication and processing of a tube. For example, when fastened in place, the plates 60 prevent movement of the first and second support sections (and elements thereof) relative to one another by the mechanical forces during tube fabrication, accidental operation of the jack screw 50, or otherwise. That is, when fastened in place, the plates 60 positively hold the first and second support sections (and elements thereof) in place for fabrication and support of a tube throughout the forming and processing of the tube. On the other hand, when the plates 60 are unfastened or are loosely fastened, the first and second support sections (and elements thereof) are made movable again whereby the mandrel 1 can be adjusted or readily disassembled to facilitate removal of the mandrel 1 without scratching or otherwise damaging the interior of the tube just fabricated.

Figure 2:
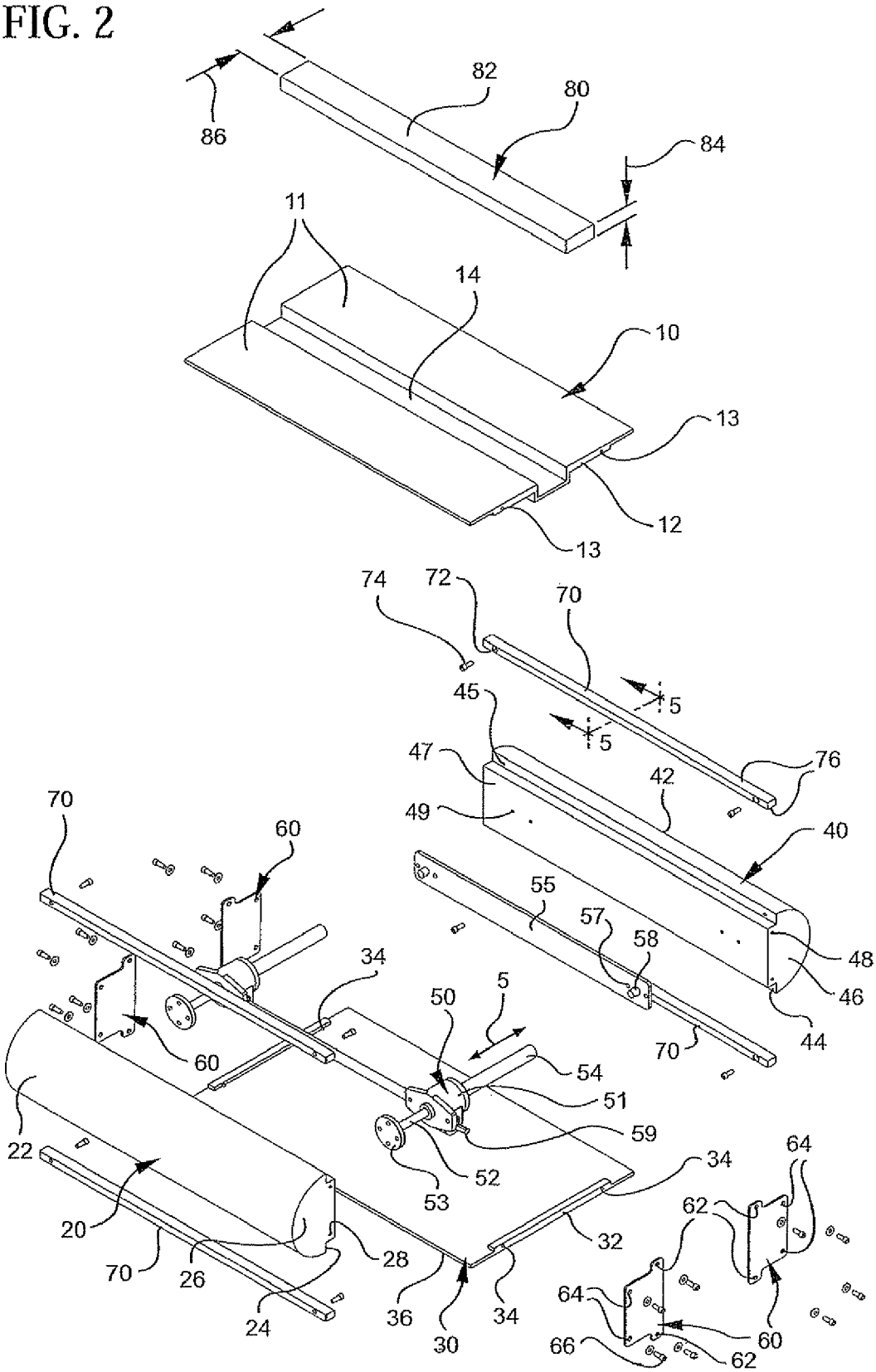
FIG. 2 is an exploded perspective view of the mandrel shown from one side.
Figure 3:
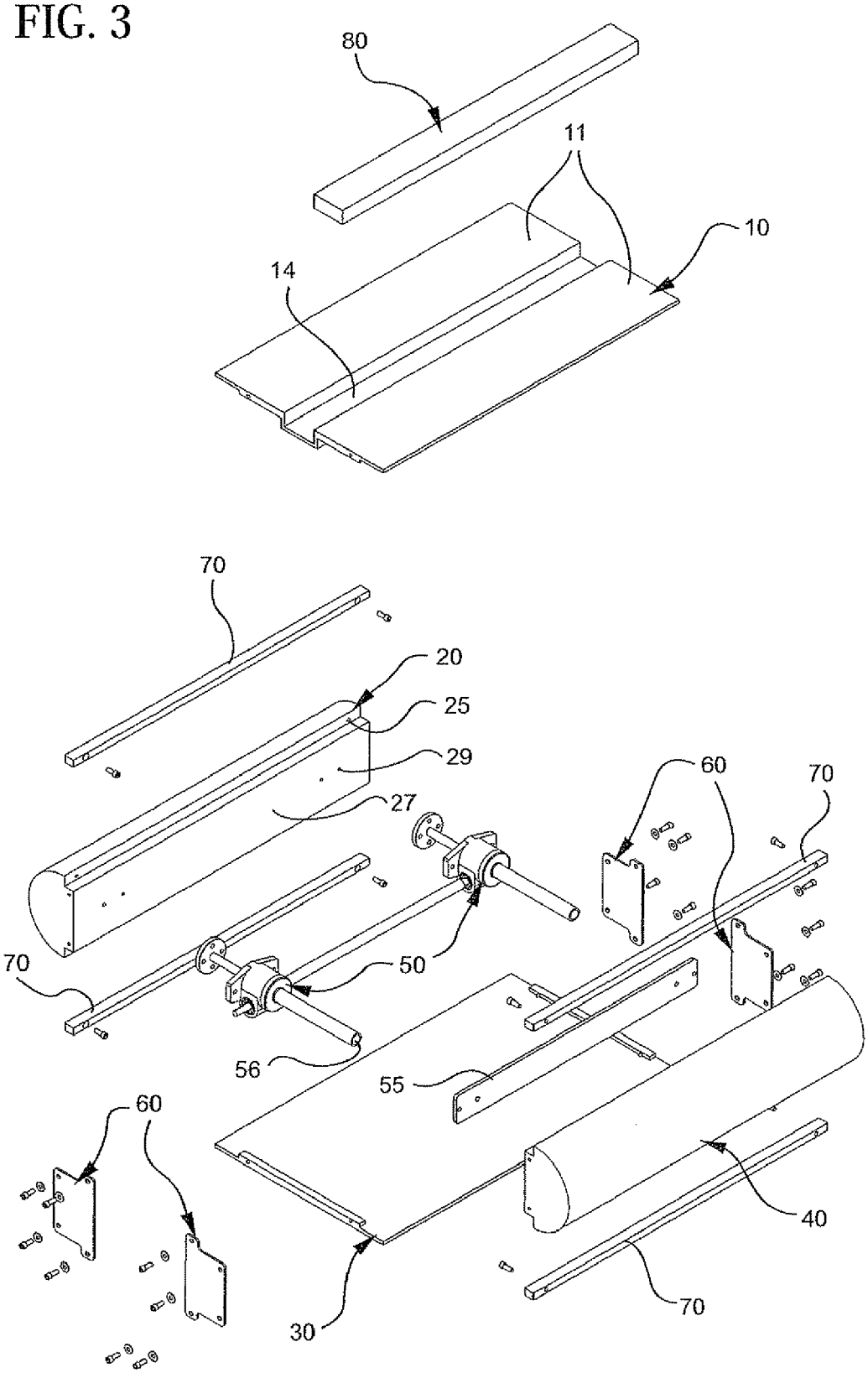
FIG. 3 is an exploded perspective view of the mandrel shown from the same side as in FIG. 1.

The mandrel 1 of FIG. 1 is shown in an exploded views in FIGS. 2 and 3.

Figure 6:
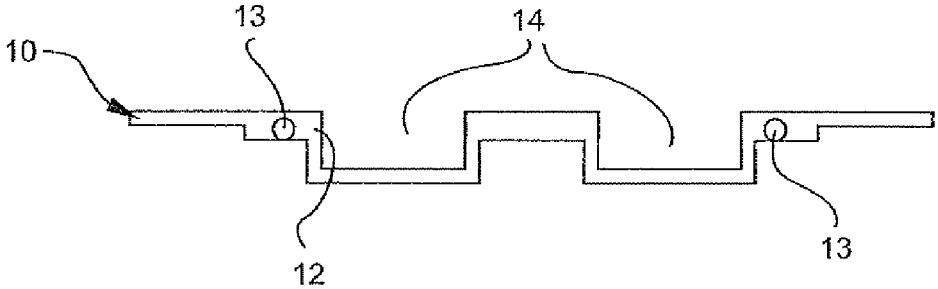
FIG. 6 is a front view of an alternative top support.

The top support 10 includes support surfaces 11 separated by a recess 14 that extends below a plane in which the support surfaces 11 are disposed. A front edge 12 of the top support 10 includes threaded holes 13. A rear edge of the top support is similar to the front edge 12, and is not specifically shown. Although only one recess 14 is shown, the top support 10 may include any suitable number of recesses 14, for example two or more as shown in FIG. 6. The number and location of the recesses 14 generally corresponds to the number and location of welded seams in the tube to be formed and supported by the mandrel 1, as is explained below.

First edge support 20 includes a rounded outer surface 22, recesses 24, and end surfaces 26. Threaded holes 25 are disposed at an edge of the recesses 24. The end surfaces 26 include threaded holes 28 therein. Further, the first edge support 20 includes an inner surface 27 having threaded holes 29 therein. The first edge support 20 may be formed as either one solid piece or as a hollow member.

The bottom support 30 includes a front edge 32 having threaded holes 34. A rear edge is similar to the front edge, and includes threaded holes 34. Further, the bottom support 30 includes a support surface 36. Although FIGS. 1-3 do not show as much, the bottom support 30 may have one or more recesses 14 similar to those disclosed in connection with the top support 10. Again, the number and location of the recesses will generally correspond to the number and location of seams in the tube to be formed and supported by the mandrel 1, as explained below. Still further, either the top support 10, the bottom support 30, or both, may include recesses 14 in any one mandrel 1.

The second edge support 40 is similar to the first edge support, and includes a rounded outer surface 42, recesses 44, and end surfaces 46. At an edge of the recesses 44 there are disposed threaded holes 45. The end surfaces 46 included threaded holes 48. Further, the second edge support 40 includes an inner surface 47 having threaded holes 49. The second edge support 40 may be formed as either one solid piece or as a hollow member.

The top support 10, first edge support 20, bottom support 30, and second edge support 40, will come into contact with the tube as the tube is formed and processed. Therefore, the top support 10, first edge support 20, bottom support 30, and second edge support 40 are made from a material that is heat resistant, has a high thermal conductivity, and high thermal shock resistance to withstand the tube processing conditions, for example localized heat of plasma spray coating. Additionally, the material is light weight so that the mandrel can easily be transported and manipulated during tube fabrication, and is easily fabricated into complex shapes. For example, the top support 10, first edge support 20, bottom support 30, and second edge support 40, may be made from aluminum, titanium, copper, or alloys of each of these metals.

Surfaces 11, 22, 36, 42, form the outer circumference of the mandrel 1 and come into contact with the interior of the tube formed about the mandrel 1. Accordingly, the surfaces 11, 22, 36, 42, are smooth so that they will not contaminate or scratch the interior of the tube. For example, the surfaces 11, 22, 36, 42, may be made of or coated with a material presenting a smooth surface. For example, if the top support 10, first edge support 20, bottom support 30, and second edge support 40, are made of aluminum, the surfaces 11, 22, 36,42, may be anodized. Alternatively, the surfaces 11, 22, 36, 42, may be coated with Teflon, nylon, zirconia, Rokide, or alumina, for example, to present a smooth surface. The anodized surface, or the materials used to coat the surfaces—including zirconia, Rokide, or alumina—further assist in providing heat resistance to the mandrel.

A jack couples the first support section to the second support section so that the outer circumference of the mandrel 1 can be adjusted. In one embodiment, the jack is a jack screw 50, and includes a body 51 having shafts 52 and 54 extending therefrom. The shaft 52 includes a mounting section 53 to mount the jack screw 50 to the first edge support 20. A mounting plate 55 includes holes 57 and posts 58. Fasteners inserted through holes 57 and into holes 49 mount the mounting plate 55 to the second edge support 40. The shaft 54 includes a recess 56 sized to fit over one of the posts 58. A shaft 59 extends through the body 51 and is connected to any suitable mechanism, for example a gear train (not shown, but as would be readily understood by one of ordinary skill in the art), for moving shafts 52 and 54 relative to one another in the direction of arrow 5 as the shaft 59 is rotated about its longitudinal axis. That is, as the shaft 59 is rotated in one direction, the total length presented by the shafts 52, 54 increases, whereas when the shaft 5 is rotated in an opposite direction, the total length presented by the shafts 52, 54 decreases. Although two jacks 50 are shown, any suitable number may be used. Generally, the number of jacks 50 will depend upon the length 3 of the mandrel 1, the number being chosen so as to provide substantially uniform adjustment of the mandrel 1 along its length 3. In the present embodiment, the shaft 59 is connected to both jacks 50 so that the jacks 50 may be adjusted simultaneously. Alternatively, the jacks 50 may be adjusted independently from one another. Instead of a jack screw 50, the jack may include a scissors jack, a hydraulic or pneumatic jack, an inflatable bladder or balloon element.

Figure 4:
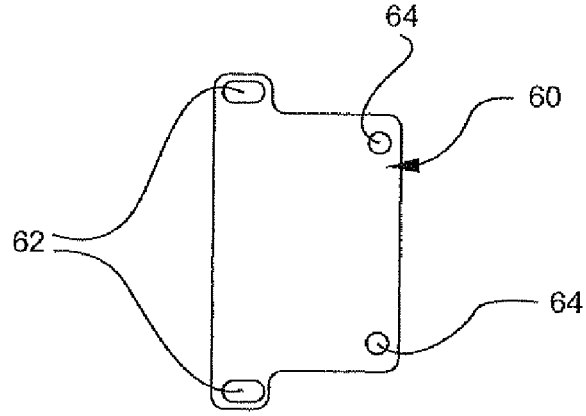
FIG. 4 is a front view of a plate that may be used in the mandrel.

Plates 60 provide rigidity and a locking element to the mandrel 1. Each plate 60 includes holes 62 and holes 64. As shown in FIG. 4, the holes 62 may be elongated, whereas holes 64 may be circular. Alternatively, holes 64 may be elongated, whereas holes 62 may be circular. In still another alternative, holes 62 and holes 64 may be elongated. Fasteners 66 are inserted through the holes 62 and into holes 13, 34, in the top support 10 and bottom support 30, respectively. Fasteners 66 inserted through holes 64 mount a plate 60 to one of the first 20 and second 40 edge supports via holes 28 and 48, respectively. Although four plates 60 are shown, any suitable number of plates may be used. Because the plates 60 do not, over any significant area, contact a tube supported by the mandrel 1, the material from which they are made is not particularly limited.

Figure 5:
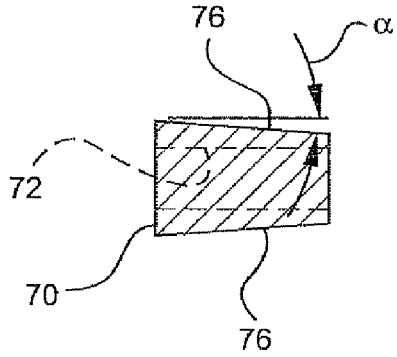
FIG. 5 is a cross-sectional view of a wedge that may be used in the mandrel and as taken along line 5-5 of FIG. 2.

Wedges 70 may be disposed in recesses 24, 44, to provide further rigidity to the mandrel 1. Each wedge 70 includes holes 72 and surfaces 76. Fasteners inserted through holes 72 and into holes 25 or 45 mount a wedge 70 to the first 20 or second 40 edge supports, respectively. For example, a wedge 70 may be disposed in a recess 24 so that its surfaces 76 contact the top support 10 and first edge support 20, thereby providing a brace therebetween. Similarly, a wedge 70 may be disposed between: the top support 10 and the second edge support 40; the bottom support 30 and the first edge support 20; and/or the bottom support 30 and the second edge support 40. FIG. 5 shows a cross section of a wedge 70 taken along line 5-5 of FIG. 2, and shows the wedge 70 as having two surfaces 76, wherein each surface 76 is disposed at an angle $\alpha$ with respect to the horizontal so as to provide a tapered surface. For two surfaces 76 on one wedge 70, each angle $\alpha$ may either have the same value, or may have a different value so as to present two tapered surfaces 76. Further either one or both of the angles $\alpha$ may be zero so that one or both of the surfaces 76 are disposed along the horizontal. Because the wedge 70 does not come into contact with a tube formed on or supported by the mandrel 1, the material from which it is made is not particularly limited.

Block 80 is provided as a removable element forming part of the outer circumference of the mandrel 1. When in place, the block 80 assists in support of the tube as it is formed and processed, and yet when removed facilitates welding of the tube. Block 80 has a top surface 82, a height 84 and a width 86. The height 84 and width 86 are chosen so that the block 80 is sized to fit within recess 14 in top support 10, and so that top surface 82 is disposed in the same plane as are surfaces 11. Because the top surface 82 of the block 80 is disposed so as to form part of the outer circumference of the mandrel 1, and will contact a tube supported on the mandrel 1, the block 80 can be made from the same materials as are the top support 10, the first edge support 20, the bottom support 30, and the second edge support 40. Additionally, because top surface 82 will contact the tube formed and supported on the mandrel 1, the top surface 82 may have the same characteristics and features as the surfaces 11, 22, 36, and 42, namely, characteristics in terms of smoothness and material. Further, the number of blocks 80 may match the number of recesses 14, wherein one block 80 is disposed in each recess 14. Alternatively, more than one block 80 may be disposed in any one recess 14, depending upon the length 3 of the mandrel. If a long mandrel 1 is used, there may be used two blocks 80 in one recess. For example, one block 80 may be inserted from the front of the mandrel 1 and another block 80 may be inserted into the same recess from the rear of the mandrel 1. Using two blocks 80 in one recess facilitates removal of the blocks 80 due to reduced amount of friction on each block 80.

Next, assembly and operation of the mandrel 1 will be explained.

First, the mandrel 1 is loosely assembled by performing the following steps, which may occur in any suitable order. Also, within each step, any of the sub-steps may be performed in any suitable order.

Each jack screw 50 that is present in the mandrel 1 is coupled to the first 20 and second 40 edge support sections. For each jack 51, the mounting section 53 is securely coupled to first edge support 20 by inserting fasteners through the holes therein and into holes 29. Mounting plate 55 is securely coupled to second edge support 40 by inserting fasteners through holes 57 and into threaded holes 49. The recess 56 of each jack screw 50 is disposed over a post 58.

The top support 10 is positioned in the recesses 24, 44 on the top of first 20 and second 40 edge supports. First and second plates 60 are loosely coupled to the top support 10 and the first edge support 20 by inserting fasteners 66 through holes 62, 64, and into holes 13, 28, respectively. Bottom support 30 is placed in recesses 24, 44 on the bottom of first 20 and second 40 edge supports. Third and fourth plates 60 are loosely coupled to the bottom support 30 and the second edge support 40 by inserting fasteners 66 through holes 62, 64 and into holes 34, 48, respectively. Fasteners 66 are also inserted through the holes 62 in the first and second plates 60 and into the bottom support 30, as well as through the holes 62 in the third and fourth plates 60 and into the top support 10. The fasteners 66 are not completely tightened down so that the mandrel 1 is still easily adjustable.

Wedges 70 are inserted into recesses 24 and 44 and are loosely coupled to the first 20 and second 40 edge supports by inserting fasteners 74 through holes 72 and into holes 25, 45, respectively. Alternatively, the fasteners 74 may be securely tightened.

Second, the mandrel 1 is adjusted, by performing the following steps in any suitable order, so as to precisely define the circumference of the mandrel 1. Also, within each step, any of the sub-steps may be performed in any suitable order.

The jack screw 50 is adjusted so as to roughly position the first 20 and second 40 edge supports at desired locations relative to one another. Also, within each step, the sub-steps may be performed in any suitable order.

The top support 10 is positioned relative to the first 20 and/or second 40 edge supports, and various fasteners 66 are securely tightened. For example, fasteners 66 inserted through holes 64 and into first edge support 20 may be securely fastened so as to fasten the first and second plates 60 relative to the first edge support 20. Also, with respect to the first and second plates 60, fasteners 66 inserted through holes 62 and into the top support 10 may be securely fastened once the top support 10 is positioned relative to the first edge support 20.

The bottom support 20 is positioned relative to the second 40 and/or first 20 edge supports, and various fasteners 66 are securely tightened. For example, fasteners 66 inserted through holes 64 and into second edge support 40 may be securely fastened so as to fasten the third and fourth plates 60 relative to the second edge support 40. Also, with respect to the third and fourth plates 60, fasteners 66 inserted through holes 62 and into the bottom support 30 may be securely fastened once the bottom support 30 is positioned relative to the second edge support 40.

Also, if fasteners 74 have not yet been securely fastened, they may be so securely fastened at any suitable point in adjusting the mandrel 1 to securely fasten the wedges 70 to the first 10 and second 20 edge supports.

The jack screw 50 is adjusted so as to precisely position the first 20 and second 40 edge supports relative to one another. Because the top 10 and bottom 30 supports may respectively be securely attached to the first 20 and second 40 edge supports by selectively securing fasteners 66, and because of the holes 62 may be elongated, the top 10 and bottom 30 supports may also be moved along with the first 20 and second 40 edge supports, respectively. That is, even though fasteners 66 are inserted through the first and second plates 60 and into the bottom support 30, as well as through the third and fourth plates 60 and into the top support 10, if the holes 62 are elongated the holes 62 will allow the top support 10 to move relative to the second edge support 40 as well as allow the bottom support 30 to move relative to the first edge support 20, for example.

Although one order of selectively securing fasteners 66, with holes 62 being elongated, has been described, one of ordinary skill in the art would readily understand that the fasteners 66 may be inserted and secured in different orders and still provide for a fine adjustment of the top support 10, first edge support 20, bottom support 30, and second edge support 40, relative to one another so as to precisely adjust the circumference of the mandrel 1. Different orders of inserting and securing fasteners 66 may also be used if holes 64 are elongated instead of holes 62 being elongated. Still further, other orders of inserting and securing fasteners 66 may be used if both holes 62 and 64 are elongated.

Third, the mandrel 1 is rigidly locked in place so as to maintain the precisely adjusted circumference. The fasteners 66 that have not yet been tightened to this point are securely tightened. For example, fasteners 66 through the first and second plates 60 and into the bottom support 30 are securely tightened. Also, for example, fasteners 66 through the third and fourth plates 60 and into the top support 10 are securely tightened. Thus, at this point, all of the fasteners 66 will be securely tightened to lock the top support 10, first edge support 20, bottom support 30, and second edge support 40 relative to one another. Accordingly, the mandrel 1 will be rigid to withstand mechanical forces that occur during forming and processing the tube. Further, accidental adjustment of the jack screw 50 is resisted by the locking action of the plates 60 being securely fastened by fasteners 66.

Fourth, the mandrel 1 is used throughout tube forming and processing. The processing steps follow tube forming, may be performed in any order, are exemplary in nature, and the manufacture of any one tube may include some steps without including others. Further, other steps may be performed in addition to, or instead of, the processing steps below.

Tube forming. A sheet of material, platinum for example, is wrapped around the mandrel 1 and pressed, hammered, formed, or otherwise made to follow the outer circumference of the mandrel 1. Because the mandrel 1 is rigid, it is able to withstand the mechanical forces applied during tube forming.

More than one sheet of metal may be used to form the complete circumference of the tube being formed. During this step, the block or blocks 80 are disposed in any recesses 14 that are present in the mandrel 1. Depending on the size of the tube to be formed and the number of sheets used to make the tube, any suitable number of recesses may be present in the mandrel 1 to accommodate the seams between edges of a sheet or sheets. The edges of one sheet, or the edges of different sheets, are brought together over the block or blocks 80. The edges may be tack welded together.

Welding. The block or blocks 80 are removed while leaving the remaining portions of the mandrel 1 inside the tube. Then the edges of the sheet or sheets are welded together The block or blocks 80 are removed to allow the weld to be properly formed without the tube being welded to the mandrel 1, or the mandrel otherwise contaminating the tube near the weld line.

Outside surface preparation. The block or blocks 80 are re-inserted into the recess or recesses 14. The outside of the tube is then grit or sand blasted, or otherwise finished. This step may also, or alternatively, include grinding or polishing of the welded portion or other portions of the outside of the tube. The mandrel 1, including the block or blocks 80, is disposed within the tube so as to provide mechanical support to the tube as it undergoes the outside surface preparation. Support for the tube is particularly important when the tube is made of a thin sheet of material.

Coating. The outside surface of the tube may then be coated by, for example, plasma spray coating. During this step, high temperatures may be used. Because of the material from which the mandrel is made, including the coating on the outer circumference of the mandrel 1, the mandrel 1 is able to withstand the high temperatures used. Further, the mandrel 1 is designed to act as a heat sink. More specifically, the presence of the mandrel 1 inside the tube, including the substantial contact between the mandrel 1 and the tube as well as the material from which the mandrel 1 is made, allow the mandrel to absorb heat and conduct it away from the tube being processed on the mandrel 1.

Attachment of a refractory support structure. A refractory support structure may then be attached to the tube. The refractory support structure may include ceramics, glass, or other platinum structures, for example. Additionally, the process of attaching the support structure may include heat and/or pressure, for example. Examples of support structure are set forth in co-pending U.S. patent application Ser. No. 11/805,081 filed on May 22, 2007, and Ser. No. 12/080,213 filed on Apr. 1, 2008. Again, because the mandrel 1 is made rigid, the mandrel 1 provides mechanical support to the tube and prevents the tube from collapsing as other elements are being attached to the tube. Further, the mandrel 1 can withstand the temperatures used in these processes and, therefore, may remain within the tube during them.

Installation of refractory materials. In this step, the tube may be surrounded, encased, or otherwise enclosed by refractory elements to support and insulate the tube. This step may also include the use of castable materials that are sintered at high temperatures. The castable material may include refractory oxides, or oxides of $ZrO_2$, $SiO_2$, CaO, MgO, for example. Again, because the mandrel 1 is made rigid, the mandrel 1 provides mechanical support to the tube as the refractory materials are put in place around the tube. That is, the mandrel 1 prevents the tube from collapsing as other elements are being put in place around and in contact with the tube. Further, the mandrel 1 can withstand the temperatures used in these processes and, therefore, may remain within the tube during them.

Fifth, the mandrel 1 is removed from the tube by performing the following steps, which may occur in any suitable order. Also, the sub-steps within each step may be performed in any suitable order. The mandrel 1 is constructed for easy disassembly, i.e., to allow various manners and orders of removing the elements while still minimizing contact of the elements with the interior of the tube so as to avoid scratching or otherwise damaging the interior of the tube.

Fasteners 66 are removed. If all of the fasteners 66 holding one plate 60 are removed, that plate 60 may also be removed. Alternatively, only some of the fasteners 66 may be removed or loosened to allow the first and second support sections to move relative to one another. Alternatively, other fasteners 66 may be loosened or removed to allow various ones or all of the top support 10, the first edge support 20, the bottom support 30, and the second edge support 40, to move relative to one another. Still further, the fasteners 66 may be removed all at one time, or other steps in the removal process may be performed between loosening and/or removing various ones of the fasteners 66.

The plates 60 are removed. Once all of the fasteners 66 holding any one plate 60 are removed, the plate may be removed. All of the plates 60 may be removed at one time, or other steps in the removal process may be performed between removing various ones of the plates 60.

The wedges 70 are removed. Fasteners 74 are removed, and the wedges 70 are pulled back and toward the center of the mandrel 1 so as to remove the wedges 70 from the recesses 24, 44. All of the wedges 70 may be removed at one time, or other steps in the removal process may be performed between removing various ones of the wedges 70.

The top support 10 is removed. It is beneficial to remove the top support 10 after removing the wedges 70 in contact with the top support 10. That is, by first removing the wedges 70 in contact with the top support 10, the top support 10 may be lowered out of contact with the tube and then slid out of the tube without contacting the interior of the tube. Removal of the top support 10 in this manner prevents scratching of the inside of the tube.

The bottom support 30 is removed. It is beneficial to remove the bottom support 30 after removing the wedges 70 in contact with the bottom support 30. That is, by first removing the wedges 70 in contact with the bottom support 30, the bottom support 30 may be raised out of contact with the tube and then slid out of the tube without contacting the interior of the tube. Removal of the bottom support 30 in this manner prevents scratching of the inside of the tube.

Block 80 is removed. Block 80 may be removed together with removal of the support, either top support 10 or bottom support 30, in which it is disposed. It is beneficial to remove the block 80 together with the support to avoid scratching or otherwise damaging the inside of the tube. Alternatively, the block 80 may be removed prior to removing the support in which it is disposed.

The jack screw 50 is removed. The jack screw 50 is shortened along the direction of arrow 5 by turning shaft 69. The jack screw 50 may be shortened so that recess 56 is freed from post 58. Additionally, or as an alternative thereto, the fasteners securing mounting section 53 to first edge support 20 may be removed. The jack screw 50 may be shortened and removed at one time, or other steps in the removal process may be performed between shortening and removal of the jack screw 50.

The first edge support 20 is removed. It is beneficial to remove the first edge support 20 after removing the top support 10 and/or bottom support 30, and after shortening the jack screw 50. Such an order of removing the first edge support 20 allows the first edge support 20 to be moved away from substantial contact with the tube to thereby avoid scratching or otherwise damaging the inside of the tube during removal.

The second edge support 40 is removed. It is beneficial to remove the second edge support 40 after removing the top support 10 and/or bottom support 30, and after shortening the jack screw 50. Such an order of removing the second edge support 40 allows the second edge support 40 to be moved away from substantial contact with the tube to thereby avoid scratching or otherwise damaging the inside of the tube during removal.

In the above removal process, any one or more elements may be removed together with any one or more of the other elements. That is, the construction of the mandrel 1 allows various different manners and orders of removing the elements of the mandrel 1 while still minimizing or avoiding scratching or otherwise damaging the interior of the tube.

Figure 7:
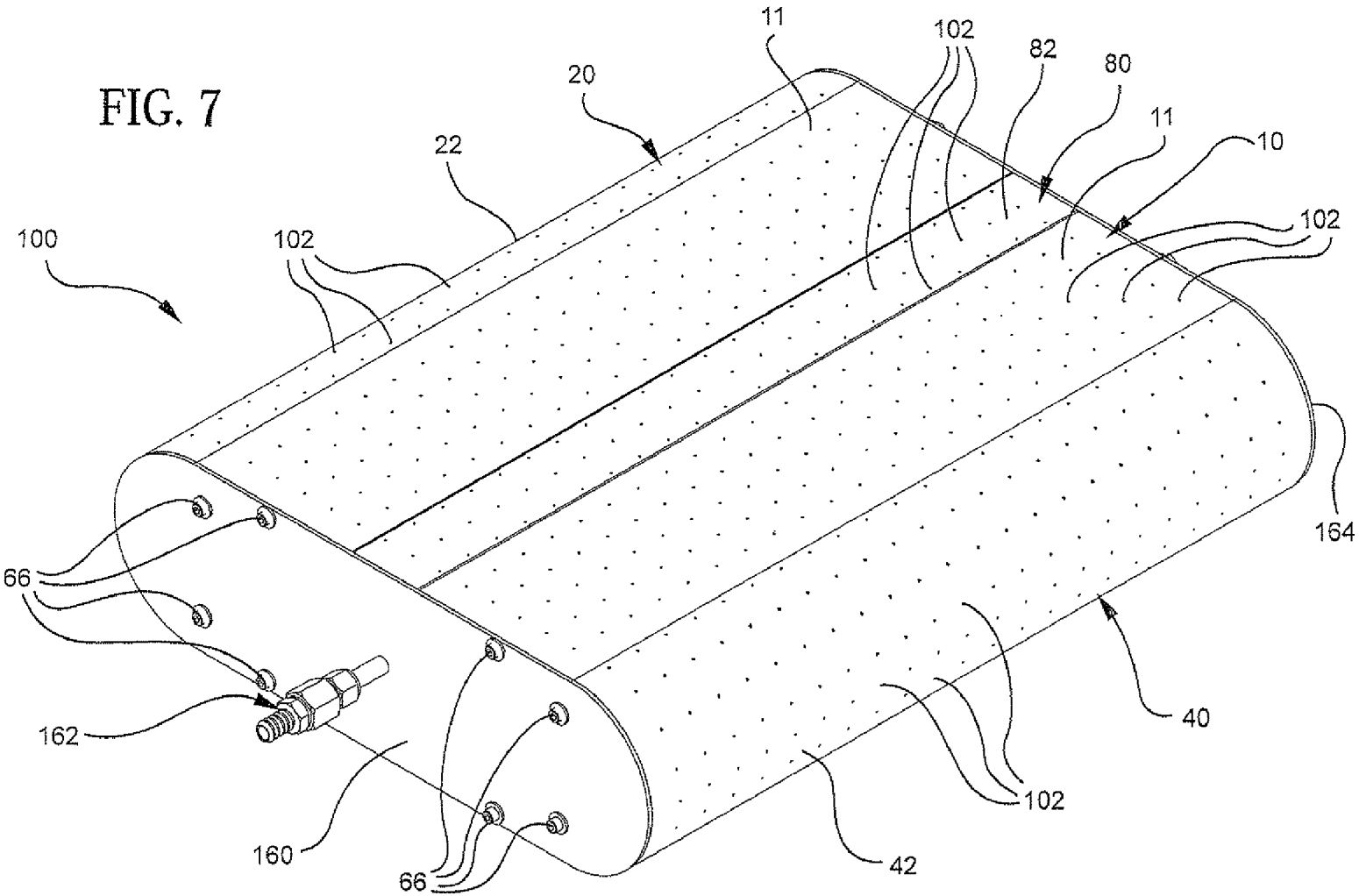
FIG. 7 is a perspective view of a second embodiment of a mandrel.

A second embodiment of the mandrel is shown in FIG. 7. In the second embodiment, mandrel 100 includes many of the same elements as does mandrel 1 described above. Accordingly, like reference numerals are used for like elements, and a detailed description of such elements is omitted here. For simplification of explanation, only the features that are different from mandrel 10 are described in detail here.

Similarly to mandrel 1, mandrel 100 includes a top support 10 having surfaces 11, a first edge support 20 having a rounded outer surface 22, a bottom support (not shown in the figure) having a support surface, a second edge support 40 having a rounded outer surface 42, and block 80 having a surface 82. Also, mandrel 100 includes a jack (not shown) within its interior. The details of the connection and interrelation of these elements are described above in connection with mandrel 1.

Further, mandrel 100 provides active heat transfer, for example heating or cooling, via its surfaces 11, 22, 42, 82, and through the surface of its bottom support (not shown). To provide active heat transfer, mandrel 100 includes a front plate 160, a back plate, a heat-transfer-medium inlet 162, and orifices 102. The heat-transfer medium may be gas or liquid, for example. For the sake of simplicity of description here, the heat-transfer medium is referred to as a gas.

In order to seal the interior of the mandrel 100, a front plate 160 and back plate are provided. The front plate 160 is sized to extend across the width of the mandrel 100 so as to contact the end surfaces of first 20 and second 40 edge supports, and the front edges of the top 10 and bottom supports. The front plate 160 is attached to the top support 10, first edge support 20, the bottom support, and the second edge support 40 by fasteners 66 inserted through holes in the front plate 160. As with the first embodiment, various ones of the holes may be either circular or elongated. A sealing element, for example an O-ring or gasket, may be provided between the front plate 160 and each of the top support 10, the first edge support 20, the bottom support, and the second edge support 40, to prevent gas from undesirably leaking out of the mandrel 100. Further, front plate 160 includes a heat-transfer-medium inlet 162 to which a source of pressurized gas may be connected to introduce pressurized gas to the interior of the mandrel 100. A back plate 164 (the particular details of which are not shown but which is similar to front plate 160, with or without a heat-transfer-medium inlet) is attached to the rear of the mandrel 100 to seal the interior of the mandrel 100.

The surfaces 11, 22, 42, 82, and the surface of the bottom support, include orifices 102 that communicate with the interior of the mandrel 100. The orifices 102 preferably are uniformly distributed over the outer circumference of the mandrel 100. When the mandrel 100 is actively cooled, the surfaces 11, 22, 42, 82, and the surface of the bottom support, may be coated with Teflon, or a lower melting temperature material, for example, nylon, and the mandrel may still be usable in a process (plasma coating for example) wherein there are high localized temperatures on the outside of the tube.

Pressurized gas is introduced into the interior of the mandrel 100, through inlet 162, and is forced out of orifices 102 so as to contact a tube formed on the mandrel 100. The gas may be any suitable gas, for example air, nitrogen, or cryogenic gases. The gas also circulates in the space between the outer circumference of the mandrel 100 and the interior of the tube formed thereon so as to heat or cool the tube and/or the mandrel.

It should be emphasized that the above-described embodiments of the present invention, particularly any "preferred" embodiments, are merely possible examples of implementations, merely set forth for a clear understanding of principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

For example, the mandrel could provide active heat transfer via liquid instead of gas, either through the above-described structure, or other structures. For example, the heat-transfer-medium inlet could be connected to a closed fluid path extending adjacent to one or more surfaces on the outer circumference of the mandrel and exiting the mandrel via a heat-transfer-medium outlet instead of through orifices in the outer circumference of the mandrel.

Additionally, for example, although the outer circumference of the mandrel is shown as an oval, any desired shape may be used for the outer circumference.

Further, for example, although some holes are described as threaded, they need not be. Any suitable form of readily removable fastener connections may be used that allow repeated fastening and unfastening. Accordingly the holes may be any suitable structure for cooperating with the fasteners used.

What is claimed is:

1. A mandrel comprising:

a first support section;

a second support section;

wherein the first support section and the second support section are disposed relative to one another so as to form an outer circumference;

a jack coupled to the first and second support sections and configured to move the first and second support sections relative to one another so as to adjust the outer circumference; and a locking element removably coupled to the first and second support sections to selectively prevent relative movement between the first and second support sections.

2. The mandrel of claim 1, wherein the first support section further comprises a recess.

3. The mandrel of claim 2, further comprising a block sized to be removably disposed within the recess and to form a portion of the outer circumference when disposed within the recess.

4. The mandrel of claim 2, wherein the first support section further comprises a second recess.

5. The mandrel of claim 1, wherein the locking element comprises a plate.

6. The mandrel of claim 5, wherein the plate comprises holes, and the mandrel further comprises fasteners disposed through the holes to removably couple the plate to the first support section and to the second support section.

7. The mandrel of claim 1, further comprising a wedge disposed between the first support section and the second support section.

8. The mandrel of claim 1, wherein the first support section and the second support section are made of aluminum, titanium, copper, or alloys thereof.

9. The mandrel of claim 8, wherein the first and second support sections are made of aluminum, and further wherein the outer circumference is anodized.

10. The mandrel of claim 1, wherein the outer circumference is coated with zirconia, alumina, or Rokide.

11. The mandrel of claim 1, wherein the first support section comprises a first edge support and a top support, removably coupled to one another.

12. The mandrel of claim 11, wherein the first edge support comprises a rounded outer surface.

13. The mandrel of claim 11, wherein the second support section comprises a second edge support and a bottom support removably coupled to one another.

14. The mandrel of claim 1, further comprising a heat-transfer-medium inlet coupled to one of the first support section and the second support section.

15. The mandrel of claim 14, further comprising orifices on the outer circumference and in communication with the heat-transfer-medium inlet.

16. The mandrel of claim 14, wherein the outer circumference is coated with Teflon or nylon.

17. A method of fabricating a tube structure comprising:

providing a mandrel according to claim 1;

forming a sheet of material about the mandrel so as to form a tube, the sheet having a first edge and a second edge;

welding the first edge and second edge to one another; and processing the tube, wherein the steps of welding and processing are performed with the mandrel inside the tube.

18. The method of claim 17, wherein the step of processing the tube comprises grinding, polishing, sand or grit blasting, coating, attaching a support structure to the tube, or disposing insulating refractory materials around the tube.

19. The method of claim 17, wherein the sheet of material comprises platinum or an alloy thereof.

20. The method of claim 17, further comprising heating or cooling the mandrel.

* * * * *